US005190281A

United States Patent [19]

Cardenas

[11] Patent Number: 5,190,281

[45] Date of Patent: Mar. 2, 1993

[54] VERTICAL SIGNATURE STACKING SYSTEM HAVING A NON-CONTACT SENSOR TO CONTROL STACK FORMATION

[76] Inventor: John Cardenas, 5 Church St., High Bridge, N.J. 08829

[21] Appl. No.: 719,174

[22] Filed: Jun. 21, 1991

[51] Int. Cl.[5] ..... B65H 31/12

[52] U.S. Cl. ..... 271/198; 271/217; 271/218; 414/790.8

[58] Field of Search ..... 271/189, 176, 198-199, 271/213-215, 217, 218; 414/790.8

[56] References Cited

U.S. PATENT DOCUMENTS

| | | | |
|---|---|---|---|
| 3,749,395 | 7/1973 | Bazzarone et al. | 271/215 |
| 4,296,684 | 10/1981 | Wangermann | 271/217 |
| 4,311,090 | 1/1982 | Dudziak et al. . | |
| 4,372,201 | 2/1983 | Dudziak et al. . | |
| 4,509,739 | 4/1985 | Kurokawa | 271/215 |
| 4,554,867 | 11/1985 | Thumm . | |
| 4,772,003 | 9/1988 | Nobuta et al. . | |
| 4,934,687 | 6/1990 | Hayden et al. | 271/217 |
| 5,039,083 | 8/1991 | Senn | 271/213 |

*Primary Examiner*—Robert P. Olszewski
*Assistant Examiner*—Steven M. Reiss
*Attorney, Agent, or Firm*—Mathews, Woodbridge & Collins

[57] ABSTRACT

The present invention is directed to a vertical stacking system comprising an apparatus and method to control stack formation based on a non-contact sensing of the reaction of the feed conveyor to the forming stack. In accordance with the invention a stream of signatures is fed by the feed conveyor onto a support surface. There is an upper feed extension of the feed conveyor located above the support surface. The stack is formed between the support surface and the feed extension. The top of the stack is adjacent to the upper feed extension. The location of the extension is determined by the location of the top of the stack. The non-contact sensing means senses the location of the feed extension and generates a location signal. This location signal is used to control a slide drive which moves the support surface.

20 Claims, 2 Drawing Sheets

VERTICAL SIGNATURE STACKING SYSTEM HAVING A NON-CONTACT SENSOR TO CONTROL STACK FORMATION

BACKGROUND OF THE INVENTION

1. Field of the Invention

The present invention relates to an apparatus for stacking signatures; more particularly, the present invention relates to a vertical signature stacking system having a means to control stack formation based on a non-contact sensing of the reaction of the feed means to the forming stack.

2. Description of Related Art

There is disclosed in the art a wide variety of horizontal and vertical stacking machines. These machines are designed to stack sheets of paper, including "signatures". Typically, the signatures have a major plane and a perimeter and are stacked with the major planes of adjacent signatures in contact with the signature perimeters aligned. The signatures are usually rectangular shaped as they are fed from a printer or folding machine. Signatures are fed at a high rate of speed to the stacker, by a conveyor belt assembly.

Horizontal stackers stack the signatures with each individual signature in a vertical position supported on an edge. The stack has a stack axis which is horizontal. Vertical stackers have a vertical stacking support which supports the major plane of the signatures. The term "vertical" is nominal, and used to indicate that the stack is formed with the stack axis vertical or at an angle to the horizontal, typically greater than 45° and most commonly at 45° to 75°.

Vertical stackers comprise a vertical stacking table having a vertical support wall. The vertical signature support wall extends from a feed end to a discharge end. The vertical signature support is nominally vertically, but typically at an angle of from 1° to 45° to the vertical. In this way the forming stack rests against the vertical support wall. The vertical stacking table has a sliding signature support fork which can translate up and down along the vertical support wall. The signature support fork can be transverse to and extending from the vertical support track. A stack is squared between the sliding signature support fork and the vertical signature support wall. There can be a feed fork assembly which supports the oncoming signatures as the stack begins to form. The signatures are fed to the stacker by a conveyor belt assembly. A useful conveyor belt assembly is shown in U.S. Ser. No. 07/688,039 filed Apr. 19, 1991 and hereby incorporated by reference. The conveyor belt assembly comprises a lower supporting feed conveyor and an upper feed conveyor. The signatures are fed to the stacker from between the lower and upper conveyors. The forming stack is transferred from the feed fork to the primary fork. The formed stack on the primary support fork is removed to a bundling and strapping apparatus where the stack is compressed and strapped to form a bundle.

In forming the bundles it is desirable to have end boards or end plates at either longitudinal end of the stack. Apparatus to automatically insert end boards during the stacking operation are disclosed in U.S. Pat. Nos. 4,372,201; 4,311,090; 4,554,867; and 4,772,003.

During operation of a vertical stacker, the signatures are fed to the stacker at a rate that is determined by operation of the system. The rate at which the support forks descend is set based on the expected signature stream speed. A continuing concern during the forming of stacks at high speeds is the correlation of the descending fork speed with the signature speed to assure process control and well formed stacks. It is undesirable for any reason for the stack to be forming faster or slower than the support fork is descending. If for example, the signatures are slightly thicker than expected the stack will be higher at the stacker and blockage of the system can occur. If the signatures are thinner than expected, the upper feed conveyor cannot precisely place each oncoming signature on the stack and a poorly formed stack can result. In order to avoid this concern the position of the upper feed conveyor belt which extends above the support forks is measured. This has heretofore been done by attempting to measure belt location, or tension. Such mechanical sensing and control means has been limited in solving this problem.

SUMMARY OF THE INVENTION

The present invention is directed to a vertical stacking system comprising an apparatus and method to control stack formation based on a non-contact sensing of the reaction of the feed means to the forming stack.

The vertical stacking system of the present invention can generally be of the type known in the art, with a preferred vertical stacker described in U.S. Ser. No. 07/688,039 filed Apr. 19, 1991 and hereby incorporated by reference.

The preferred vertical stacker comprises a frame, and a vertical support wall supported by the frame. A sliding support defining a support surface intersects the vertical support wall. There is a slide drive means to translate the sliding support along the support wall. In a preferred embodiment the sliding support can comprise a feed zone sliding support defining a feed zone support surface which intersects the vertical support wall, and a primary sliding support defining a primary support plane which intersects the vertical support wall. There can be a feed zone drive means to translate the feed zone sliding support along the support wall, and a primary slide drive means to translate the primary sliding support along the support wall. The preferred slide drive means comprises a motor.

A feed means is disposed to feed signatures to the support surface of the sliding support and form a stack of signatures thereon. The feed means preferably comprises an upper conveyor, having a upper feed section located above the support surface with the stack formed between the support surface and the upper feed section. The upper conveyor is preferably a conveyor belt. Where there is a feed zone support surface, the feed means is disposed to feed signatures to the feed zone support surface of the sliding support and form a stack of signatures thereon. There can then be a means to transfer the signatures on the feed zone support surface to the primary support surface.

The present invention further comprises a non-contact sensing means to sense the location of the upper feed section and generate a location signal. The non-contact sensing means is a preferably a laser, but other non-contact sensors such as photoelectric cells can be used. The laser is disposed to sense the location of the upper feed section of the conveyor. Preferably, the laser measures in a direction relative to the support surface. During the formation of the stack the upper conveyor, preferably an upper conveyor belt is in contact with the top of the stack. The laser is measuring the location of the upper conveyor belt. The upper conveyor has an operating zone in which the stack can satisfactorily form. During the formation of the stack the upper conveyor moves up into operating zone. If the stack is growing too rapidly it will press against the upper conveyor and cause it to move up above the operating zone. If the stack is growing too slowly a gap will form between the upper conveyor and the upper conveyor will be at a lower location, below the operating zone which indicative of when there is no stack forming. The laser can continually sense the change in location of the upper conveyor. The laser generates a location signal in response to the location of the upper conveyor.

A slide drive control means controls the slide drive means in response to the location signal. A suitable means such as wire or radio signals communicates the location signal to a the slide drive control means.

The present invention includes a method to control stack formation based on a non-contact sensing of the reaction of the feed means to the forming stack. In a preferred embodiment the method includes feeding a stream of signatures to the above described a vertical stacking system. The location of the upper feed section is sensed with a non-contact sensing means; and a location signal is generated based on the sensed location of the upper feed section. The slide drive means is controlled with a slide drive control means in response to the location signal.

The following terms are used throughout the application. The apparatus is directed to stacking planar sheet-like material commonly known as "signatures". The signatures include single sheets or folded sheets typically made of paper or light cardboard. The apparatus is particularly useful in line with graphic arts machinery, such as printing presses and folding equipment.

A stack is an aligned plurality of signatures. Each signature has a major plane adjacent to the major plane of the adjacent signature. The perimeters of adjacent signatures are aligned. The stack has a stack axis which is generally perpendicular to the major plane of each signature and extends along the length of the stack.

A bundle is a compressed and secured, typically by plastic strapping, stack.

By a vertical stacker it is meant that an apparatus that forms a stack with the stack axis being at an angle to the horizontal. Typically, the angle is between 45° and 90° to the horizontal and most typically, between 45° and 75° with a typical and preferred angle of the stack being at 60° to the horizontal. As will be seen, this provides support for the stack along the stack end and one of the sides parallel to the stack axis.

The vertical stacking system of the present invention comprises features which can be used independently with other stackers, including horizontal stackers. The features are used in combination in accordance with the preferred vertical stacking system of the present invention.

The vertical stacker of the present invention comprises a frame, a vertical support wall supported by the frame. As indicated above, the vertical support wall is preferably at an angle of from 45° to 75° to the horizontal. The vertical stacking wall is preferably formed by a plurality of rollers. The rollers define a plane and angle of the wall. There is a sliding support defining a support plane which intersects the vertical support wall. Such a support plane is preferably a fork having prongs protruding through spaces between the rollers forming the vertical support wall. The upper surface of the prongs define a primary support plane.

There is a slide drive means to vertically translate the sliding support in the direction along the vertical support wall. Typically, this is a chain drive attached to a fork support means behind the vertical support wall. The chain causes the support plane to move vertically along the support wall. Preferably, the support plane is perpendicular to the plane defined by the support wall. The reason for this is that the stack nominally has a flat side which can rest against a support wall, and a stack perpendicular to the stack axis.

There is a means to feed signatures to the support plane of the primary sliding support to form a stack of signatures thereon. Signatures can be fed to the stacking machines at speeds up to and more than 80,000 signatures per hour. The stacking system of the present invention can handle a flow of signatures up to 80,000 signatures or more and typically, from 10,000 to 50,000 signatures per hour. There is a suitable means to feed the signatures to the primary support plane of the primary sliding support and form a stack of signatures thereon. A preferred feed means comprises a conveyor belt system on which a stream of overlapping signatures is continually fed to the vertical stacker system of the present invention.

The vertical stacking system has a feed zone along the vertical support wall. There can be a feed zone sliding support having a feed zone support plane which intercepts the vertical support wall. Preferably, the feed zone sliding support is a fork having a plurality of prongs extending through the spaces between the rollers defining the vertical support wall. The upper surface of the prongs define a feed zone support plane. The signatures being fed to the vertical stacker initially are fed directly onto the feed zone support plane and a stack begins to form with each successive signature being deposited on the preceding signature. As the stack forms, the feed zone sliding support moves vertically downward away from the conveyor belt. There is a feed zone drive means which is preferably a driven chain interconnected to a prong support means of the fork. The feed zone drive means translates the feed zone support plane in a controlled manner along the support wall vertically downward at the rate at which the stack is forming.

In a preferred embodiment of the present invention, the rate at which the feed zone support plane moves vertically downward can be controlled by a above recited non-contact sensing means. The non-contact sensing means can sense the location of the upper conveyor belt adjacent to the top of the forming stack. The oncoming signatures are deposited on the stack between the top signature on the stack and the upper conveyor belt. Based on the location of the upper belt, the rate at which the vertical plane descends can be controlled. The non-contact sensing means can be located at any suitable location. This feature enables the growing stack to move at a variable rate depending on the rate of the oncoming signatures. Additionally, it prevents hang-ups at the feed point. Finally, it can compensate for inconsistencies in the concentration of signatures along the signature feed stream.

In accordance with the present invention, the signature on the feed support plane begins to grow. The feed support plane translates vertically down away from the feed zone toward the primary support plane. The primary support plane preferably has an end board thereon and comes up to meet the feed support. When the end board is immediately beneath the bottom of the feed support fork, the feed support fork can be retracted and the base of the stack is deposited on the end board. The signatures are then continually fed onto the forming stack which is now on the primary support plane, with the end board between the primary support plane and the base of the stack.

A gap in the signature stream is coordinated to the completion of the formation of the stack on the primary support means. Upon formation of the completed stack, the primary support means moves down the vertical wall. At the bottom of the vertical wall is a base having a base support plane disposed to receive the stack of signatures from the primary sliding support. Preferably, the base is composed of a plurality of rollers perpendicular to the vertical support wall. The prongs of the primary support fork move through the gaps between the rollers with the end of the stack on an end board being supported on the rollers. The rollers can be used as part of a base travel path along which the signature stack can be transported.

DESCRIPTION OF THE PREFERRED EMBODIMENTS

The preferred embodiment of the stacking system of the present invention will be apparent to those skilled in the art by reference to the accompanying Figures.

Figure 1:
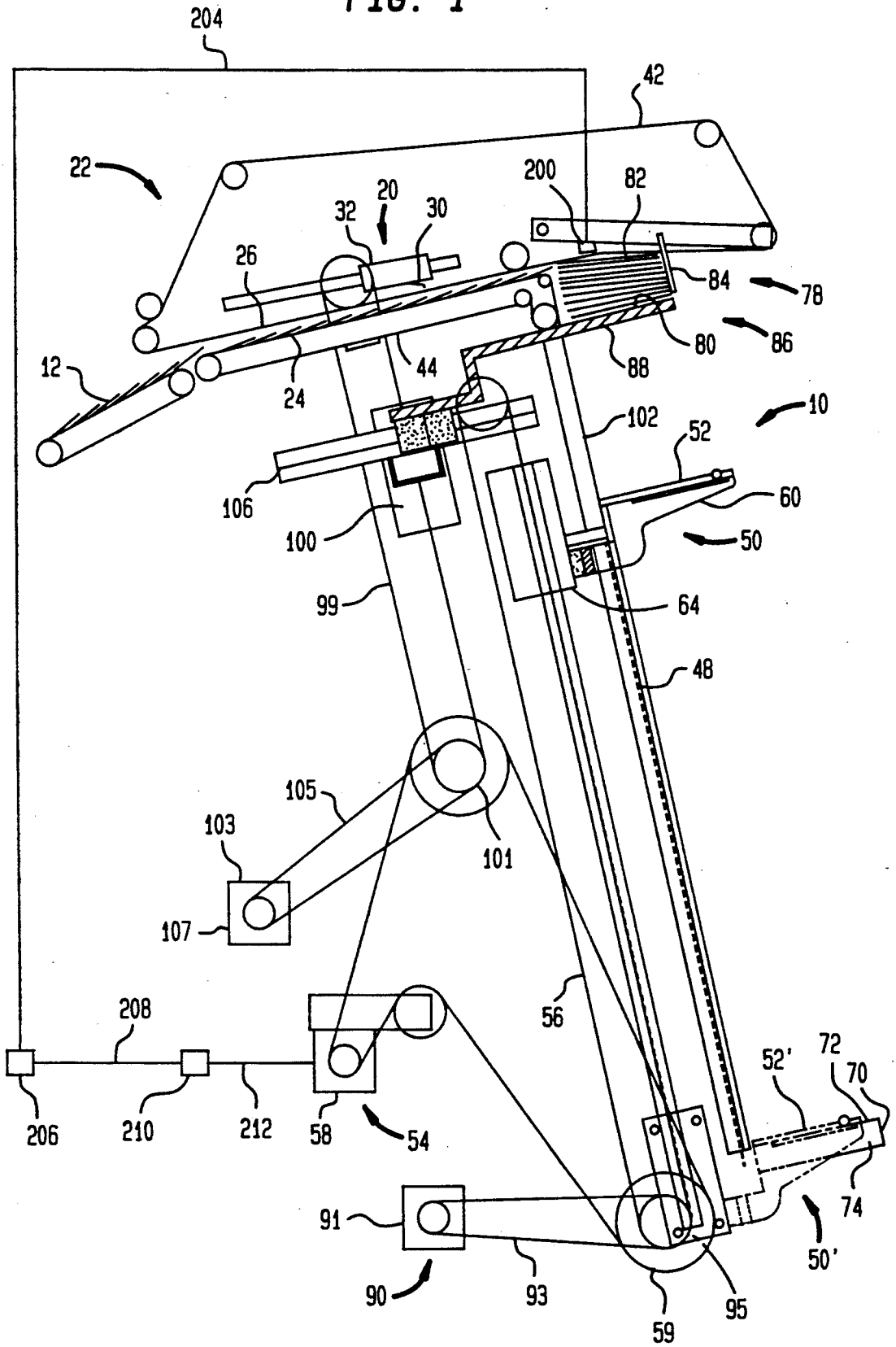
FIG. 1 is a schematic side view of the a vertical stacker present invention showing the stacker apparatus with a laser sensing and control system during normal operation.
Figure 2:
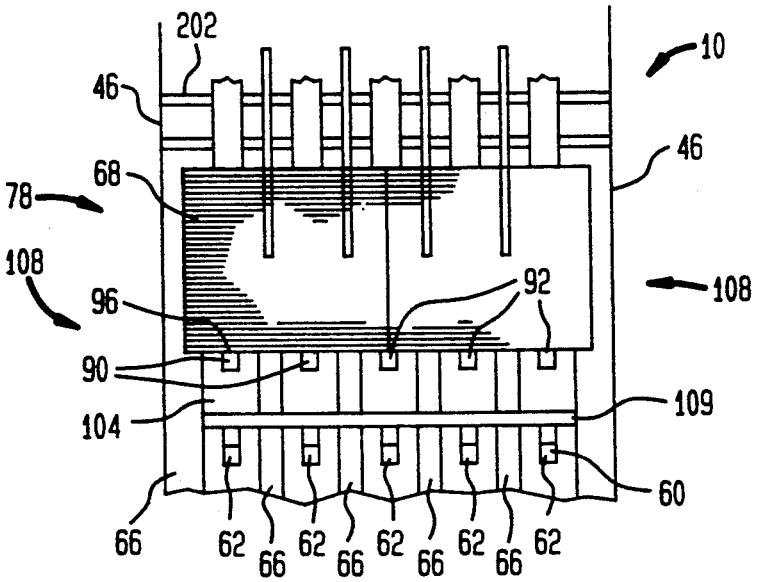
FIG. 2 is a front view of the feed zone of the embodiment illustrated in FIG. 1.
Figure 3:
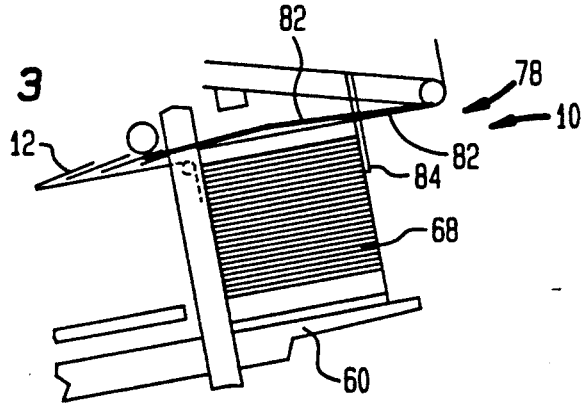
FIG. 3 is a side view of the vertical stacker of the present invention showing the upper feed belt pushed upward by a stack which is forming too fast.
Figure 4:
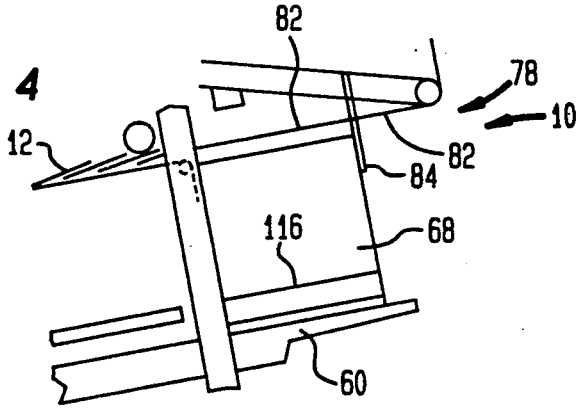
FIG. 4 is a side view of the vertical stacker of the present invention showing the upper feed belt in a low nonoperating position when the stack is forming too slow.

FIGS. 1 and 2 are schematic views of the a vertical stacker present invention showing the stacker apparatus with a laser sensing and control system during normal operation. FIG. 3 is a side view of the feed zone showing the upper feed belt pushed upward by a stack which is forming too fast. FIG. 4 is a side view of the feed zone showing the upper feed belt in a low nonoperating position when the stack is forming too slow.

Referring to FIGS. 1 and 2, the vertical stacking apparatus 10, there is a stream of signatures 12 coming to vertical stacking apparatus 10. There is preferably a gapping or interrupt apparatus 20 through which an oncoming stream of signatures are fed. Any suitable gapping apparatus 20 can be used with a preferred gapping apparatus described in U.S. Ser. No. 07/717,931, filed Jun. 20, 1991 by Balcerek et. al.

In accordance with the system shown in FIGS. 1 through 4, a stack of signatures enters the system through the conveyor feed system 22 in stacker 10. The signatures are stacked in stacker 10 to form a vertically disposed stack. The vertically disposed stack can then be transported to strapping and bundling apparatus (not shown) where the stack is compressed and secured by a suitable strap. The strapped bundle can then be transported to palletizing apparatus (not shown).

The apparatus of the present invention is simple to operate and capable of handling signatures having an incoming speed in a range of from up to 80,000 or more signatures per hour, and preferably 10,000 to 50,000 sheets per hour. The most preferred speed rates are in the range from 10,000 to 50,000 sheets per hour. The apparatus can be easily adjusted to be used with devices using signatures at any speeds in the indicated range, whether signatures come at a variable rate.

The stream of signatures 12 typically arrives on a suitable conveying means such as a conveyor belt assembly 22. It is desirable in the operation of a vertical stacking apparatus to have a means to interrupt the stream or form a gap. A useful gapping apparatus is located as shown in FIG. 1. A flow of signatures enters the gapper 20 on lower entry conveyor belt 24. A suitable gap can be formed as desired.

The lower entry conveyor 24 can be a separate conveyor belt or segment of the conveyor belt bringing the signatures to the vertical stacking apparatus 10. Opposing the lower entry conveyor segment of the gapper 24 there is an upper gapper conveyor belt section 26. The relative speeds of lower entry conveyor 24 and upper gapper conveyor belt 26 can be controlled relative toward one another. Upper gapper conveyor belt 26 can be lowered onto the oncoming stream of signatures 28. By controlling the relative speeds of the lower belt 24 and upper belt 26 the lower stream of signatures 28 can be interrupted and a gap formed. This gap is important in vertical stacking apparatus 10 to enable completed stacks to be removed and new stacks to be begun to form. In a preferred operation, the gapping apparatus 20 further comprises an interrupter means which can be a lance or hook 30 which simultaneously advances at the same speed as upper gapper conveyor belt 26.

In a preferred embodiment the speed of the lower conveyor belt remains the same as the oncoming stream, The speed of the upper gapper conveyor belt can be varied to accelerate or decelerate that portion of the stream of signatures with which it is in contact. By accelerating signatures, they will be pulled away from the signatures not yet in contact with the belt and a gap formed. More preferably, upper belt 26 is operated at a slower speed to permit the flow of signatures which have passed the gapping apparatus 20 to move and be processed in the vertical stacking apparatus 10 while the gapper 20 is slowing down the oncoming signatures and actually interrupting their flow to cause separation in the stream.

The lance or hook 30 travels at a simultaneous speed as upper belt 26 in the direction of the signatures being transported by suitable hook transport means 32 associated with the upper conveyor belt. There is suitable means to raise and lower upper gapper conveyor belt 26 and hook toward and away from the flowing stream of signatures supported on lower entry conveyor 24. In a most preferred embodiment in operation, the upper gapper conveyor belt has means to control its speed to be less than the lower entry conveyor belt 26 speed. Preferably the speed of the upper belt 26 is one-third and more preferably one-half of the speed of the signature stream. Upon lowering of the upper conveyor belt to contact the moving signature stream, the hook 30 or lance is simultaneously lowered to intercept the leading edge of the stream of a signature at which a gap is to be formed. The hook can be advanced by a suitable means at the same speed as the belt 26.

Alternately, when the speed of conveyor belt 26 is increased more rapidly than the stream 12 it causes greater separation of oncoming signatures. This can be used to prevent piling up of the overlapping signatures.

The vertical stacking apparatus 10 comprises a frame 46. There is a vertical support wall 48 supported by frame 46. The vertical support wall 48 is preferably made up of a plurality of rollers 66 having a plane which defines the vertical support wall 48. The plane of the roller of these support rollers also defines the angle of the vertical stacker to the horizontal. Preferably, the vertical support wall is at an angle of greater than 45°, and most preferably from 45° to 75° with a common angle being 60° to the horizontal.

There is a sliding support assembly 50. The sliding support assembly 50 is shown in a position toward the top of the vertical stacker, while the sliding support assembly 50' is the same assembly shown at the bottom of the vertical wall 48. The sliding support 50 defines a support plane or surface 52 which intersects and is preferably transverse or perpendicular to the vertical support wall 48. There is a slide drive means. The slide drive means preferably comprises further comprises a first motor drive 54 interconnected to the sliding support assembly 50, preferably by a first chain or belt 56, driven by slide chain first motor 58 connected to first chain drive 59, to translate the sliding support assembly 50 along support wall 48.

In a preferred embodiment, the slide support assembly 50 comprises a slide support fork 60. The slide support fork 60 comprises a plurality of slide support prongs 62. The upper surfaces of the slide support fork prongs 62 define the support plane or surface 52 of the sliding support. Preferably, this support plane 52 is perpendicular to the vertical support wall 48. The sliding support fork prongs are connected to a sliding support 64 which in turn is connected to slide chain 56. The prongs 62 extend from between vertical support wall rollers 66 as shown in FIG. 2.

Upon completion of the formation of the stack 68, the sliding support assembly with sliding support plane 52 are lowered along vertical wall support 48. At the lower end of vertical wall support 48 is a base support 70. Base support 70 has a base support plane 72. The base support plane preferably is parallel to the support plane 52 of the sliding support plane. In the preferred embodiment, the base support 70 comprises a plurality of rollers of base support rollers 74. The sliding support assembly in the preferred embodiment comprises sliding support fork prongs which lower through spaces between base support rollers 74 thereby depositing the stack of signatures 68 on the base support 70.

The vertical stacker apparatus has a feed zone 78. The feed zone 78 is the portion of the vertical stacker apparatus 10 which receives the oncoming stream of signatures 28. When a stack 68 is formed, the slide support assembly 50 slides down from the vertical wall to deposit the completed stack 68 on base support plane 72, preferably base support rollers 74. The support assembly containing the stack 68 is preferably lowered by a third motor drive means 90 interconnected to the primary sliding support. Preferably, third motor drive means 90 comprises a motor 91 connected by a chain or belt to first chain drive 59. There is a means to control which motor drives chain 56, such as by a clutch 95. Chain drive 59 can be driven by first motor 58 or third motor 91. Typically, and preferably first motor assembly is a DC motor used to lower slide assembly 50 having a stack 68 thereon. Third motor assembly 91 can be an AC or DC motor. This latter assembly 91 is used to lower and raise primary sliding support assembly 50 more rapidly. This is the case when the stack 68 is complete and is quickly lowered to base 70, and when assembly is returned empty to its uppermost position. The third motor drive assembly 90 is interconnected only to the primary sliding support 50.

While the primary sliding support 50 is being lowered to base 70 to discharge stack 68, the stream of signatures 12 is continuing to move toward the vertical wall 48, typically at very rapid speed. Accordingly, the gapping apparatus 20 provides a reprieve by forming a small interruption in the otherwise continuous stream of signatures 28. However, this gap is not sufficient in length to permit a sufficient amount of time for the completed stack 68 to be placed on the base 70, transported from the stacking apparatus 10, out of the path of the oncoming stack of signatures, and the primary support fork 60 to return to the top of the wall 48.

In accordance with the present invention there is a feed zone sliding support plane or surface which can slide along wall 48. As in the vertical wall 48, the feed zone can be a continuation of the rollers of wall 48 or separate vertical rollers. However, the feed zone need not be rollers, since the formed stack is not transported transversely to the portion of the vertical wall within the feed zone.

The feed zone sliding support plane 80 receives signatures from the signature stream 12. As the stack of signatures accumulates on the feed zone support plane 80, the feed zone support plane 86 slides down the vertical wall toward the base support 70. The travel of the feed zone support plane 80 is limited to the feed zone 78. When the primary sliding support plane 52 has been relieved of the completed stack, it moves up the vertical wall via slide chain 56 and the forming stack 68 on the feed zone support plane 80 is deposited onto the support plane 52 of the primary sliding support assembly.

The feed zone sliding support 86 supporting the oncoming stack is driven by the first motor assembly 54. The first motor assembly 54 is preferably used to lower either the feed zone sliding support or the primary sliding support.

When the first motor assembly 54 is used to lower the feed zone sliding support 86, it is interconnected through feed zone slide chain 99 to support 86 through feed chain drive 101. When the feed zone sliding support 86 is retracted and raised it is driven by second motor assembly 103 through second chain 105. There is a suitable means, such as a clutch means 97 to enable the first motor 58 or the second motor 103 to engage either the feed chain drive 101. Typically, and preferably, first motor assembly 54 is used to lower feed zone sliding support 86 when it is supporting a forming stack. Second motor assembly 103 is used to return the feed zone sliding support 86 to its uppermost position. The second motor 107 can be an AC or a DC motor, and is preferably, and AC motor.

In a preferred embodiment of the present invention, signatures are fed along a conveyor system 22 to lower feed conveyor 44 and immediately before the feed zone are fed between opposing feed conveyors, upper feed conveyor 42 and lower feed conveyor 44. Lower feed conveyor 44 ends at the vertical support wall 48. The upper feed conveyor 42 has an upper feed conveyor feed extension 82. There is also a suitable means to stop the forward progress of the cylinders, such as signature stop 84. The oncoming signatures are thereby shepherded into place by upper and lower feed conveyors 42 and 44. Their forward progress is stopped by signature stop 84 and they are continually forced by feed extension 82 onto the stack feed zone support plane 80. This quickly and neatly forms a stack on feed zone support plane 80. The stack of signatures is thereby formed on feed zone support plane 80, i.e., the support surface, between the support surface and the upper feed extension 82. The stack has a stack top adjacent to the upper feed extension 82. The location of the feed section extension 82 is determined by the location of the top of the stack.

The preferred feed zone sliding support assembly 86 comprises a feed zone support plane 80. The support plane 80 is on a suitable feed zone support which is preferably a feed zone fork 88. The feed zone fork 88 comprises a plurality of feed zone fork prongs 92 as shown in FIG. 2. There are preferably a plurality of feed zone prongs on the fork with the preferred number of prongs being equal to the number of prongs on the primary support fork 60. Preferably, there are from two to six prongs 62 on the primary sliding support fork 60 and corresponding number of prongs 92 on the feed zone support fork 90. The upper surface of the feed zone support prongs defines the feed zone support surface 96 (i.e., feed zone support plane 80).

The feed zone support fork 90 is supported on the chain by a suitable feed zone support 100. The feed zone chain and feed zone support are preferably behind the vertical wall 48. The feed zone support fork prongs 92 extend from the feed zone support through slots, preferably between feed zone rollers 102 in the feed zone. The slots are vertical and preferably aligned with the slots in the same area of the wall 48 which the prongs 62 of the primary sliding support assembly slides 50.

The preferred feed zone support assembly preferably has feed zone support prongs 92 extending through the feed zone slots 104, as shown in FIG. 2. The feed zone support fork prongs are preferably retractable so that the fork can be retracted completely behind the surface defined by the front of wall 48. There is a suitable retractable piston 106. When the primary sliding support assembly 50 has been lowered away from the oncoming stream of signatures 12, the gap formed at the gapper is momentarily present during which time the feed zone support prongs 92 are shot out in front of the vertical wall 48 to receive oncoming signatures. As the signatures build on the feed zone support surface 96 the feed zone support assembly slides down via feed zone chain 99.

After the formed stack on the sliding support assembly 50 has been removed, the slide support assembly 50 moves up the vertical wall via motor assembly three 90. The support plane 50 having an end board 109 is in the transition zone 108 as shown in FIG. 2.

When the bottom of the transition zone support fork intersects the end board 109 supported on support plane 42, the feed zone support prongs 92 rapidly retract and the forming stack of signatures is deposited on end board 109. This all occurs very rapidly and the primary support surface 52 continues to move downwardly as the stack is built.

When the completed stack is resting on base support 70, there is a means to transfer the signature stack 68 from the vertical stacker to the next operation, such as bundler strapper.

It has been found that even small variations in the signatures or signature stream, such a variations in thickness of each sheet will add up in large stacks so that manual adjustment of the speed of descent of the stack has been previously required. FIGS. 1 and 2 illustrate normal operation. The upper belt at upper belt extension section 82 is raised slightly by the forming stack. Typically, during normal operation the upper belt extending over the forming stack is raised from ¼ to 1¼ inches. FIG. 3 illustrates a condition when the extension section 82 is raised too much, i.e., greater than about 1¼ inches. This could result in a blocking of the system and failure to stack. FIG. 4 illustrates a condition when the stack 68 is not in contact with extension section 82. This could happen, for example if the signatures are too thin. The extension section 82 than returns to an nonoperating position. Because the extension section 82 is not pressing against the top of the stack, oncoming signatures may not correctly be placed on top of the stack by extension section 82 propelling the signature forward to stop 84. It is therefore desirable to monitor the stacking process and control the process to assure that the extension section 82 is correctly located on top of the forming stack 68.

In accordance with the present invention this is accomplished by a non-contact sensing of the reaction of the feed means to the forming stack.

The slide drive control means can control at least one of the first motor drive, second motor drive, and the third motor drive in response to the location signal and preferably, only the first motor drive in response to the location signal.

Preferably, this is accomplished by measuring the location of extension section 82. This can be accomplished by locating a laser 200 in a suitable position to measure the location of extension section 82. Laser 200 is shown attached to laser support 202, which can be directly or indirectly attached to frame 46. The laser can be above any of the individual belts making up upper conveyor 42. The laser 200 senses the position of extension section 82 and converts it to a suitable voltage signal which is transmitted by suitable means such as laser wire 204 to a controller 206. Controller 206 converts the laser signal to a suitable format. The controller than sends a signal via controller wire 208 to the motor controller 210 to control the rate of chains 56 and/or 99 and their respective support assemblies 50 and/or 86. The laser and controller assembly shown in FIG. 1 is shown only for use to control first motor assembly 54. However, it can analogously be used to control second motor assembly 103 and third motor assembly 90.

A preferred laser and controller assembly for use in accordance with the present invention is the laser displacement sensor available from Keyence Corporation, 2-23 Aketa-cho, Takatsuki, Osaka 569, Japan. Particularly, preferred is laser sense LB-11, used in combination with controller LB-70. This is described in Keyence LB-70/LB-11, LB-72/LB-12. Laser Displacement Ensor, Instruction Manual (LB-1-2-1290 Printed in Japan), pages 1–10 and 16–17 are hereby incorporated by reference.

While exemplary embodiments of the invention have been described, the true scope of the invention is to be determined from the following claims.

What is claimed is:

1. A vertical stacking system comprising:

a frame;

a vertical support wall supported by the frame;

a sliding support defining a support surface which intersects the vertical support wall;

a feed means to feed signatures to the support surface of the sliding support and form a stack of signatures thereon, the feed means comprising an upper conveyor, having a upper feed extension located above the support surface with the stack formed between the support surface and the upper feed extension, the stack having a stack top adjacent to the upper feed extension, whereby the location of the feed extension section is determined by the location of the top of the stack top.

a non-contact sensing means to sense the location of the upper feed extension and generate a location signal; and a slide drive control means to control the slide drive means in response to the location signal.

2. The vertical stacking system as recited in claim 1 further comprising:

a base support defining a base support plane disposed to receive a stack of signatures from the sliding support, the base support comprising a base travel path along which the signature stack can be transported; and a transport device comprising a carriage disposed to travel along a track juxtaposed to the base travel path, the transport device comprising means to propel the stack intact.

3. The vertical stacking system as recited in claim 1 wherein the upper conveyor comprises a conveyor belt.

4. The vertical stacking system as recited in claim 3 wherein the a slide drive means comprises a motor.

5. The vertical stacking system as recited in claim 3 wherein the non-contact sensing means is a laser.

6. The vertical stacking system as recited in claim 5 wherein the laser is disposed to measure the location of the upper feed extension in a direction relative to the support surface.

7. The vertical stacking system as recited in claim 5 wherein the laser generates the location signal.

8. The vertical stacking system as recited in claim 6 wherein there is means to communicate the location signal to a the slide drive control means.

9. The vertical stacking system as recited in claim 1 wherein the sliding support further comprises:

a feed zone sliding support defining a feed zone support surface which intersects the vertical support wall;

a feed zone drive means to translate the feed zone sliding support along the support wall, the feed means disposed to feed signatures to the feed zone support surface of the sliding support and form a stack of signatures thereon;

a primary sliding support defining a primary support plane which intersects the vertical support wall;

a primary slide drive means to translate the primary sliding support along the support wall; and a means to transfer the signatures on the feed zone support surface to the primary support surface.

10. The vertical stacking system as recited in claim 9 further comprising a base support defining a base support plane disposed to receive a stack of signatures from the primary sliding support.

11. The vertical stacking system as recited in claim 9 wherein there is an end board located on the primary support plane.

12. The vertical stacking system as recited in claim 9 wherein the feed zone sliding support comprises a feed zone fork comprising a plurality of feed zone prongs the upper surface of which define the feed zone support surface; and the primary zone sliding support comprises a primary zone fork comprising a plurality of primary zone prongs the upper surface of which define the primary zone support surface.

13. The vertical stacking system as recited in claim 12 wherein means to transfer the signatures on the feed zone support plane to the primary support plane further comprises a means to retract the feed zone fork with the feed zone support plane above the primary zone support plane.

14. The vertical stacking system as recited in claim 9 wherein the slide drive means further comprises:

a first motor drive interconnected to the feed zone sliding support and to the primary sliding support;

a means to enable the first motor to engage either the feed zone sliding support or the primary sliding support;

a second motor drive interconnected only to the feed zone sliding support; and a third motor drive interconnected only to the primary sliding support.

15. The vertical stacking system as recited in claim 14 wherein the slide drive control means can control the first motor drive in response to the location signal.

16. The vertical stacking system as recited in claim 14 wherein the slide drive control means can control at least one of the first motor drive, second motor drive, and the third motor drive in response to the location signal.

17. A method comprising:

feeding a stream of signatures to a vertical stacking system comprising a frame; a vertical support wall supported by the frame; a sliding support defining a support surface which intersects the vertical support wall; a slide drive means to translate the sliding support along the support wall; a feed means to feed signatures to the support surface of the sliding support, the feed means comprising an upper conveyor, having a upper feed extension located above the support surface;

forming a stack of signatures on the support surface between the support surface and the upper feed extension, the stack having a stack top adjacent to the upper feed extension, whereby the location of the feed extension section is determined by the location of the top of the stack;

sensing the location of the upper feed extension with a non-contact sensing means;

generating a location signal based on the sensed location of the upper feed section; and controlling the sliding drive means with a slide drive control means in response to the location signal.

18. A vertical stacking system comprising:

a frame;

a vertical support wall supported by the frame;

a sliding support defining a support surface which intersects the vertical support wall, the sliding support further comprising:

a feed zone sliding support defining a feed zone support surface which intersects the vertical support wall;

a primary sliding support defining a primary support plane which intersects the vertical support wall;

a first motor drive interconnected to the feed zone sliding support and to the primary sliding support;

a means to enable the first motor engage wither the feed zone sliding support or the primary sliding support;

a second motor drive interconnected only to the feed zone sliding support; and a third motor drive interconnected only to the primary sliding support;

a means to transfer the signatures on the feed zone support surface to the primary support to form a stack of signatures thereon, the feed means comprising an upper conveyor, having a upper feed extension located above the support surface with the stack formed between the support surface and the upper feed extension;

a non-contact sensing means to sense the location of the upper feed section and generate a location signal; and a slide drive control means to control the slide drive means in response to the location signal.

19. The vertical stacking system as recited in claim 18 wherein the slide drive control means can control the first motor drive in response to the location signal.

20. The vertical system as recited in claim 18 wherein the slide drive control means can control at least one of the first motor drive, second motor drive, and the third motor drive in response to the location signal.

* * * * *